US011222587B2

(12) United States Patent
Toyomura

(10) Patent No.: US 11,222,587 B2
(45) Date of Patent: Jan. 11, 2022

(54) PIXEL CIRCUIT, DISPLAY DEVICE, DRIVING METHOD OF PIXEL CIRCUIT, AND ELECTRONIC APPARATUS

(71) Applicant: Sony Semiconductor Solutions Corporation, Kanagawa (JP)

(72) Inventor: Naobumi Toyomura, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 16/969,720

(22) PCT Filed: Jan. 25, 2019

(86) PCT No.: PCT/JP2019/002540

§ 371 (c)(1),
(2) Date: Aug. 13, 2020

(87) PCT Pub. No.: WO2019/163402

PCT Pub. Date: Aug. 29, 2019

(65) Prior Publication Data

US 2021/0005137 A1 Jan. 7, 2021

(30) Foreign Application Priority Data

Feb. 20, 2018 (JP) ..... JP2018-027890

(51) Int. Cl.
*G09G 3/3233* (2016.01)

(52) U.S. Cl.
CPC ..... *G09G 3/3233* (2013.01); *G09G 2300/0833* (2013.01); *G09G 2320/0233* (2013.01)

(58) Field of Classification Search
CPC ..... G09G 3/3233; G09G 2300/0833; G09G 2300/0819; G09G 2300/0842;
(Continued)

(56) References Cited

U.S. PATENT DOCUMENTS 6,859,193 B1 * 2/2005 Yumoto ..... G09G 3/325 345/82
8,248,329 B2 * 8/2012 Yamamoto ..... H01L 27/3272 345/76
(Continued)

FOREIGN PATENT DOCUMENTS

JP 2007-298973 A 11/2007
JP 2009-014933 A 1/2009
(Continued)

*Primary Examiner* — Mihir K Rayan
(74) *Attorney, Agent, or Firm* — Michael Best & Friedrich LLP

(57) ABSTRACT

To provide a pixel circuit capable of suppressing a decrease in luminance due to leakage of a transistor without increasing the number of elements or with a minimum increase in the number of elements even if the number is increased.
A pixel circuit is provided including a light-emitting element, a drive transistor configured to supply a current to the light-emitting element, a first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor.

10 Claims, 12 Drawing Sheets

(58) Field of Classification Search
CPC ..... G09G 2300/0866; G09G 2300/0469; G09G 2310/0248; G09G 2320/0233; G09G 2320/0252; G09G 2320/0214; G09G 2330/021
See application file for complete search history.

(56) References Cited

U.S. PATENT DOCUMENTS

| | | | | |
|---|---|---|---|---|
| 8,648,840 | B2 * | 2/2014 | Uchino | G09G 3/3233 345/204 |
| 2003/0142052 | A1 * | 7/2003 | Matsumoto | G09G 3/3648 345/87 |
| 2004/0207615 | A1 * | 10/2004 | Yumoto | G09G 3/325 345/211 |
| 2005/0012758 | A1 * | 1/2005 | Christou | G09G 3/20 345/619 |
| 2005/0140605 | A1 * | 6/2005 | Jung | G09G 3/3233 345/76 |
| 2008/0036371 | A1 * | 2/2008 | Kim | G09G 3/3233 313/504 |
| 2011/0157144 | A1 * | 6/2011 | Park | G09G 3/3233 345/212 |
| 2017/0148384 | A1 * | 5/2017 | Lee | G09G 3/3233 |
| 2017/0345883 | A1 * | 11/2017 | Song | G09G 3/3233 |

FOREIGN PATENT DOCUMENTS

| | | | |
|---|---|---|---|
| JP | 2014-071450 | A | 4/2014 |
| JP | 2015-025978 | A | 2/2015 |
| JP | 2015-034861 | A | 2/2015 |
| JP | 2016-038425 | A | 3/2016 |
| WO | 2013/076774 | A1 | 5/2013 |

* cited by examiner

RELATED ART

PIXEL CIRCUIT, DISPLAY DEVICE, DRIVING METHOD OF PIXEL CIRCUIT, AND ELECTRONIC APPARATUS

TECHNICAL FIELD

The present disclosure relates to a pixel circuit, a display device, a driving method of the pixel circuit, and an electronic apparatus.

BACKGROUND ART

In recent years, in the field of display devices, a flat (flat-panel) display device in which pixels including light-emitting units are arranged in rows and columns (a matrix) has become the mainstream. One example of the flat display devices is an organic electroluminescence (EL) display device using a so-called current-driven electro-optical element such as an organic EL element whose emission luminance changes according to the value of a current flowing through a light-emitting unit.

In a flat display device a typical example of which is this organic EL display device, transistor characteristics (for example, a threshold voltage) of a drive transistor that drives an electro-optical element varies from pixel to pixel due to process variations or the like in some cases. For example, Patent Document 1 discloses a technology of a display device capable of shortening a writing time of an initialization voltage to a gate node of a drive transistor in performing correction operation of characteristics of the drive transistor.

CITATION LIST

Patent Document

Patent Document 1: Japanese Patent Application Laid-Open No. 2015-034861

SUMMARY OF THE INVENTION

Problems to be Solved by the Invention

In such an organic EL display device, a driving method in which output of a video signal is stopped at the time of displaying a still image to reduce power consumption is becoming common. When output of a video signal is stopped at the time of displaying a still image, a constant current needs to be continuously supplied to an organic EL element in a pixel circuit, and the luminance changes if the operating point of a drive transistor changes. MOS, low-temperature polycrystalline silicon (LTPS), and the like have relatively large leakage currents. If the number of transistors is increased to maintain the operating point of the drive transistor, pixel layout at a narrow pitch becomes difficult, which hinders high definition of the display.

Thus, in the present disclosure, a new and improved pixel circuit, display device, driving method of the pixel circuit, and electronic apparatus are proposed which can suppress a decrease in luminance due to leakage in a transistor without increasing the number of elements or with a minimum increase in the number of elements even if the number is increased.

Solutions to Problems

According to the present disclosure, there is provided a pixel circuit including a light-emitting element, a drive transistor configured to supply a current to the light-emitting element, a first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor.

Furthermore, according to the present disclosure, there is provided a driving method of a pixel circuit including a light-emitting element, a drive transistor configured to supply a current to the light-emitting element, the first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor, the method including turning on the first write transistor and the second write transistor in a first period after light emission ends, correcting the threshold voltage of the drive transistor in a second period after the first period, writing a signal voltage to the drive transistor in a third period after the second period, and turning off the first write transistor and the second write transistor and allowing a current to flow through the light-emitting element through the drive transistor to cause the light-emitting element to emit light in a fourth period after the third period.

Effects of the Invention

As described above, according to the present disclosure, it is possible to provide a new and improved pixel circuit, display device, driving method of the pixel circuit, and electronic apparatus which can suppress a decrease in luminance due to leakage in a transistor without increasing the number of elements or with a minimum increase in the number of elements even if the number is increased.

Note that the effects described above are not necessarily limited, and along with or in lieu of the effects described above, any of the effects described in the present Description, or another effect that can be grasped from the present Description may be exhibited.

MODE FOR CARRYING OUT THE INVENTION

Figure 1:
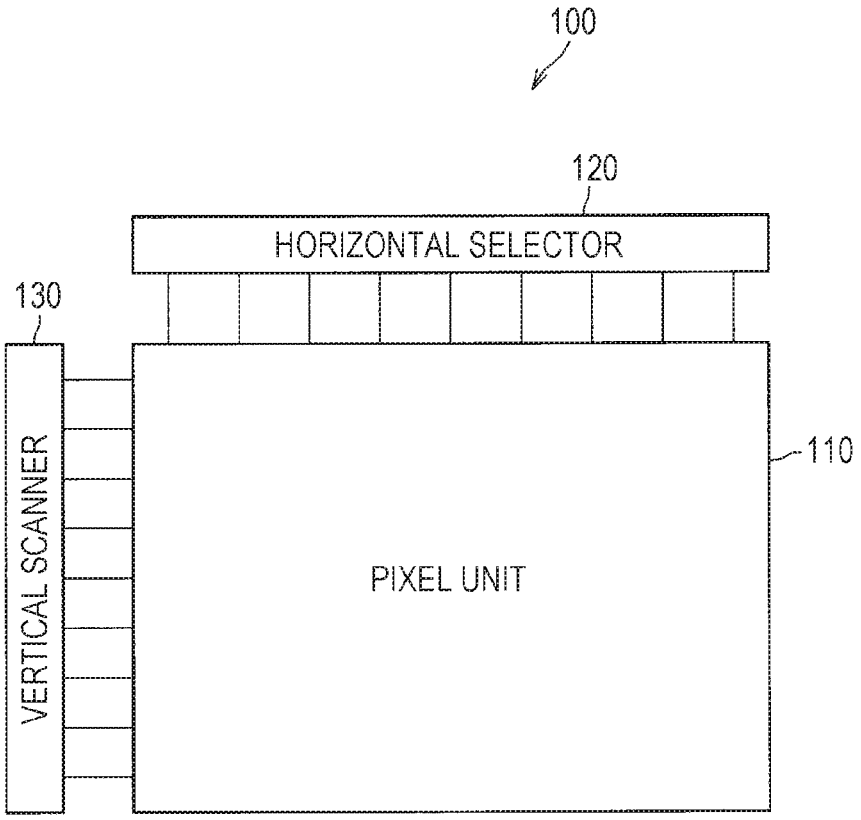
FIG. 1 is an explanatory diagram illustrating a configuration example of a display device 100 according to an embodiment of the present disclosure.

Hereinafter, a preferred embodiment of the present disclosure will be described in detail with reference to the accompanying drawings. Note that in the present Description and the drawings, the same reference signs denote constituents having substantially the same functional configuration and an overlapping description will be omitted.

Note that the description will be given in the following order.

1. Embodiments of Present Disclosure 1.1. Description in General of Display Device, Driving Method of Display Device, and Electronic Apparatus of Present Disclosure 1.2. Configuration Example and Operation Example 2. Summary

1. Embodiments of Present Disclosure

1.1. Description in General of Display Device, Driving Method of Display Device, and Electronic Apparatus of Present Disclosure A display device according to the present disclosure is a flat (flat-panel) display device in which a pixel circuit is arranged, the pixel circuit having a sampling transistor and a holding capacitance in addition to a drive transistor that drives a light-emitting unit. Examples of the flat display device include an organic EL display device, a liquid crystal display device, a plasma display device, and the like. Among these display devices, in the organic EL display device, an organic EL element is used as a light-emitting element (electro-optical element) of a pixel. In the organic EL element, electroluminescence of organic material is used to utilize a phenomenon of emitting light when an electric field is applied to an organic thin film.

An organic EL display device in which an organic EL element is used as a light-emitting unit of a pixel has the following advantages. That is, since the organic EL element can be driven by an applied voltage of 10 V or less, the organic EL display device consumes lower power. Since the organic EL element is a self-luminous element, the organic EL display device has higher image visibility than a liquid crystal display device, which is also an example of the flat display device. Furthermore, since the organic EL display device does not require a lighting member such as a backlight, the weight and the thickness of the organic EL display device can be easily reduced. Moreover, since the response speed of the organic EL element is as high as several microseconds, the organic EL display device does not generate an afterimage when a moving image is displayed.

The organic EL element is a self-luminous element and is also a current-driven electro-optical element. Examples of the current-driven electro-optical element include an inorganic EL element, an LED element, a semiconductor laser element, and the like, in addition to an organic EL element.

A flat display device such as an organic EL display device can be used as a display unit (display device) in each of various electronic apparatuses including the display unit. Examples of the various electronic apparatuses include, in addition to a television system, a head-mounted display, a digital camera, a video camera, a game console, a laptop personal computer, a portable information apparatus such as an electronic book, a mobile communication apparatus such as a personal digital assistant (PDA) or a mobile phone, and the like.

In the display device, the driving method of the display device, and the electronic apparatus according to the present disclosure, a drive unit may be configured to set a gate node of the drive transistor to a floating state and then set a source node to a floating state. Furthermore, the drive unit may be configured to cause the sampling transistor to write a signal voltage while the source node of the drive transistor is kept to be a floating state. A configuration may be adopted where an initialization voltage is supplied to a signal line at a timing different from that of the signal voltage, and is written from the signal line to the gate node of the drive transistor by sampling performed by the sampling transistor.

In the display device, the driving method of the display device, and the electronic apparatus according to the present disclosure including the above-described preferable configuration, a configuration may be adopted where the pixel circuit is formed on a semiconductor such as silicon. Furthermore, the drive transistor may include a P-channel transistor. The reason for using a P-channel transistor instead of an N-channel transistor as the drive transistor is as follows.

In a case where a transistor is formed on a semiconductor such as silicon instead of an insulator such as a glass substrate, the transistor does not have three terminals of source/gate/drain, but has four terminals of source/gate/drain/back gate (base). Then, in a case where an N-channel transistor is used as the drive transistor, a back-gate (substrate) voltage is 0 V, which adversely affects operation of correcting variation in threshold voltages of the drive transistor for each pixel, and the like.

Furthermore, variation in characteristics of a transistor is smaller in a P-channel transistor without a lightly doped drain (LDD) region than in an N-channel transistor having an LDD region, which is advantageous in achieving miniaturization of a pixel and in turn, higher definition of the display device. For such a reason and the like, in a case where formation on a semiconductor such as silicon is assumed, it is preferable to use a P-channel transistor instead of an N-channel transistor as the drive transistor.

In the display device, the driving method of the display device, and the electronic apparatus according to the present disclosure including the above-described preferable configuration, also the sampling transistor may include a P-channel transistor.

Alternatively, in the display device, the driving method of the display device, and the electronic apparatus of the present disclosure including the above-described preferable configuration, the pixel circuit may include a light-emission control transistor that controls light emission/non-light emission of the light-emitting unit. At this time, also the light-emission control transistor may include a P-channel transistor.

Alternatively, in the display device, the driving method of the display device, and the electronic apparatus of the present disclosure including the above-described preferable configuration, the holding capacitance may be connected between the gate node and the source node of the drive transistor. Furthermore, the pixel circuit may include an auxiliary capacitance connected between the source node of the drive transistor and a node of a fixed potential.

Alternatively, in the display device, the driving method of the display device, and the electronic apparatus of the present disclosure including the above-described preferable configuration, the pixel circuit may include a switching transistor connected between a drain node of the drive transistor and a cathode node of the light-emitting unit. At this time, also the switching transistor may include a P-channel transistor. Furthermore, the drive unit may be configured to make the switching transistor conductive during a non-light emitting period of the light-emitting unit.

Alternatively, in the display device, the driving method of the display device, and the electronic apparatus according to the present disclosure including the above-described preferable configuration, the drive unit may be configured to set a signal for driving the switching transistor to an active state before a sampling timing of the initialization voltage by the sampling transistor. Then, the drive unit may set a signal for driving the light-emission control transistor to an active state and thereafter to an inactive state. At this time, the drive unit may be configured to cause the sampling transistor to complete sampling of the initialization voltage before the signal for driving the light-emission control transistor is set to the inactive state.

1.2. Configuration Example and Operation Example

Subsequently, a configuration example of the display device according to an embodiment of the present disclosure will be described. FIG. 1 is an explanatory diagram illustrating a configuration example of a display device 100 according to an embodiment of the present disclosure. Hereinafter, a configuration example of the display device 100 according to the embodiment of the present disclosure will be described with reference to FIG. 1.

A pixel unit 110 has a configuration where pixels each provided with a self-luminous element such as organic EL elements or the like are arranged in a matrix. In the pixel unit 110, for the pixels arranged in a matrix, scanning lines are provided in a horizontal direction in units of lines, and a signal line is provided for each column so as to be orthogonal to the scanning lines.

A horizontal selector 120 sequentially transfers a predetermined sampling pulse and sequentially latches image data with the sampling pulse, and thus distributes the image data to each signal line. Furthermore, the horizontal selector 120 performs an analog-to-digital conversion process on the image data distributed to each signal line, and thus generates a drive signal representing the emission luminance of each pixel connected to each signal line by time division. The horizontal selector 120 outputs this drive signal to a corresponding signal line.

A vertical scanner 130 generates a drive signal for each pixel in response to driving of the signal line by the horizontal selector 120, and outputs the drive signal to a scanning line SCN. As a result, the display device 100 causes the vertical scanner 130 to sequentially drive each pixel arranged in the pixel unit 110, causes each pixel to emit light at the signal level of each signal line set by the horizontal selector 120, and displays a desired image on the pixel unit 110.

Figure 2:
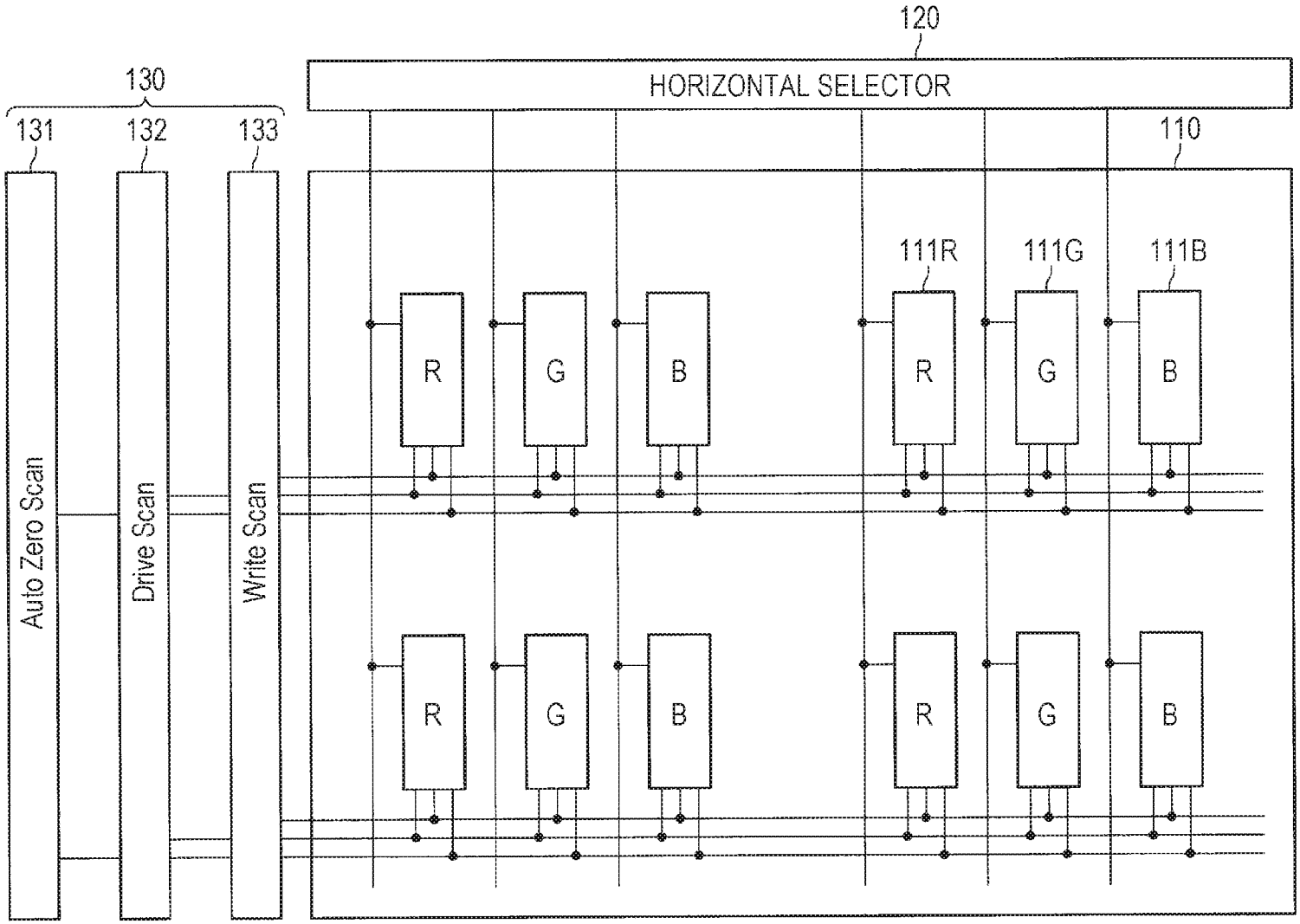
FIG. 2 is an explanatory diagram illustrating a more detailed configuration example of the display device 100 according to the embodiment.

FIG. 2 is an explanatory diagram illustrating a more detailed configuration example of the display device 100 according to the embodiment of the present disclosure. Hereinafter, a configuration example of the display device 100 according to the embodiment of the present disclosure will be described with reference to FIG. 2.

In the pixel unit 110, pixels 111R that display red, pixels 111G that display green, and pixels 111B that display blue are arranged in a matrix.

Then, the vertical scanner 130 includes an auto zero scanner 131, a drive scanner 132, and a write scanner 133. By supplying signals from the respective scanners to the pixels arranged in a matrix in the pixel unit 110, TFTs provided in the respective pixels are turned on and off.

Figure 3:
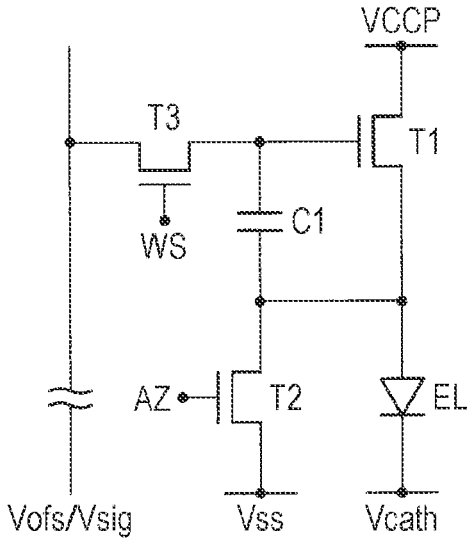
FIG. 3 is an explanatory diagram illustrating an example of a pixel circuit.

Various forms of each pixel provided in the pixel unit 110 are conceivable. For example, FIG. 3 illustrates a pixel circuit including three N-channel transistors and one capacitor. The pixel circuit illustrated in FIG. 3 is a pixel circuit including N-channel transistors T1, T2, and T3, a capacitor C1, and an organic EL element EL. Details of driving of the pixel circuit are described in, for example, Japanese Patent Application Laid-Open No. 2008-225345 and the like, and the detailed description is omitted. The transistor T1 is a drive transistor for supplying a current to the organic EL element EL. The transistor T2 is a write transistor for writing a video signal. The transistor T3 is a reset transistor for extinguishing light of the organic EL element EL and resetting an anode potential. The pixel circuit illustrated in FIG. 3 is a circuit having a function of correcting a threshold voltage (Vth correction) of the transistor T1, which is a drive transistor, and a function of correcting variation in mobility.

In recent years, a driving method for reducing power consumption by stopping output of a video signal when a still image is displayed, mainly for a panel for mobile use or the like, is becoming common. That is, a driving method of performing low-frequency driving at the time of displaying a still image is being adopted. In this case, it is necessary to continue supplying a constant current to the organic EL element in the pixel circuit. That is, the operating point of the drive transistor (transistor T1 in the pixel circuit illustrated in FIG. 3) must not change during still image display. An oxide TFT has excellent leakage characteristics and is compatible with this driving. In contrast, in MOS, LTPS, and the like, since a leakage current is relatively great, and it is difficult to maintain the operating point of the drive transistor, luminance decreases during display of a still image.

Figure 4:
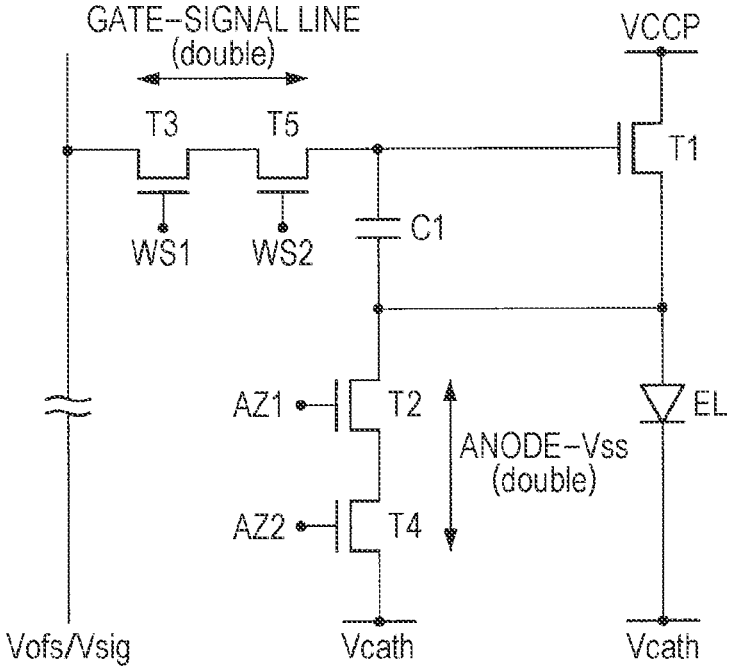
RELATED ART FIG. 4
FIG. 4 is an explanatory diagram illustrating an example of the pixel circuit.

Therefore, in order to suppress the leakage current of the transistors, a method of adding an N-channel transistor in series with each of the transistors T2 and T3 in the pixel circuit illustrated in FIG. 3 is conceivable. FIG. 4 is an explanatory diagram illustrating a configuration example of the pixel circuit. The pixel circuit has a configuration in which N-channel transistors T4 and T5 are added to the pixel circuit illustrated in FIG. 3. By adding the transistors T4 and T5 as described above, there are two transistors between the gate of the transistor T1, which is the drive transistor, and the signal line to which a signal Vsig is supplied, and there are two transistors between the anode of the organic EL element EL and a signal line that supplies a reset voltage Vss.

As described above, each of the write transistor and the reset transistor includes two transistors connected in series. Therefore, it is possible to suppress the leakage current of the drive transistors and to suppress a decrease in luminance during display of a still image.

An example in which the pixel circuit is configured by using N-channel transistors has been described so far. However, even in a case where a pixel circuit is configured by using P-channel transistors, it is possible to adopt the method of suppressing a leakage current of the transistors by connecting the transistors in series.

Figure 5:
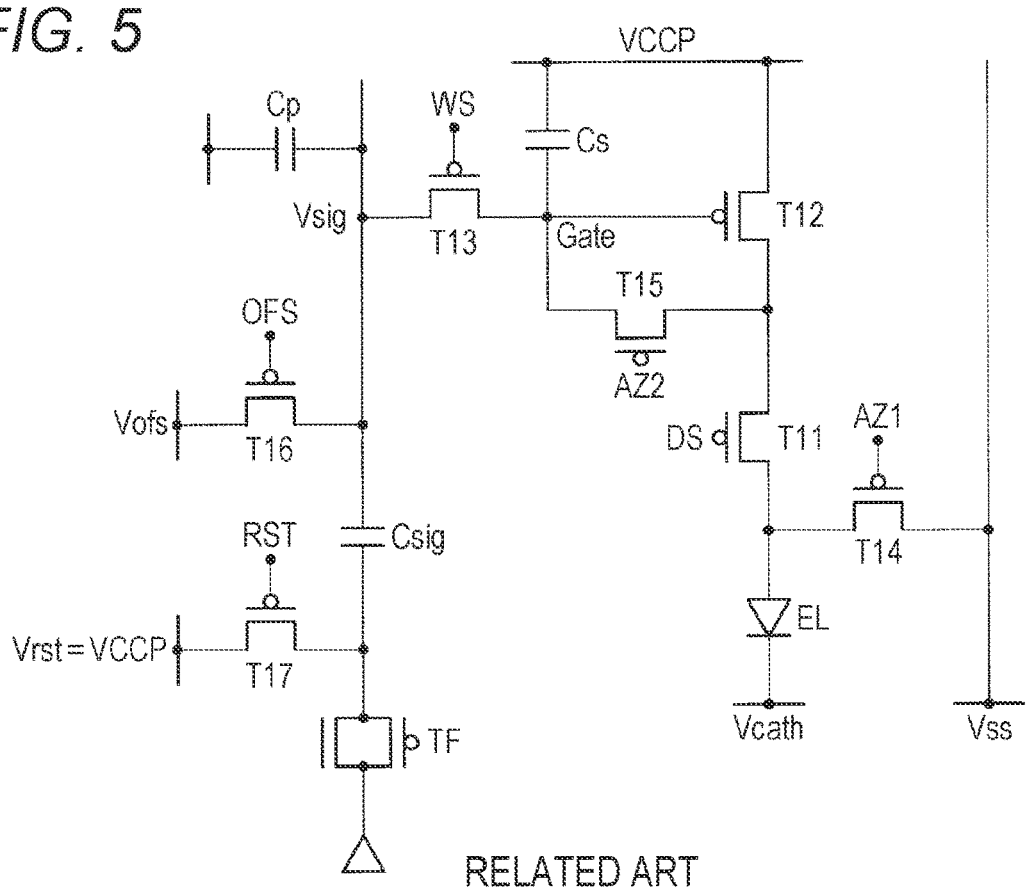
FIG. 5 is an explanatory diagram illustrating an example of the pixel circuit.

FIG. 5 is an explanatory diagram illustrating an example of a pixel circuit including five P-channel transistors and one capacitor. The pixel circuit illustrated in FIG. 5 is a pixel circuit including P-channel transistors T11, T12, T13, T14, and T15, a capacitor Cs, and an organic EL element EL. Furthermore, in FIG. 5, transistors T16 and T17 and a transfer gate TF that operate when each pixel is driven are illustrated.

Details of driving of the pixel circuit are described in, for example, Japanese Patent Application Laid-Open No. 2015-152775 and the like, and the detailed description is omitted. The transistor T1 has a gate connected to a signal line DS, a drain connected to an anode of the organic EL element EL, and a source connected to a drain of the transistor T2. A video signal Vsig is supplied to the gate of the transistor T2 via the transistor T3, and the source of the transistor T2 is connected to a power supply voltage VCCP. The gate of the transistor T3 is connected to a signal line WS. The gate of the transistor T4 is connected to a signal line AZ1. The gate of the transistor T5 is connected to a signal line AZ2.

Figure 6:
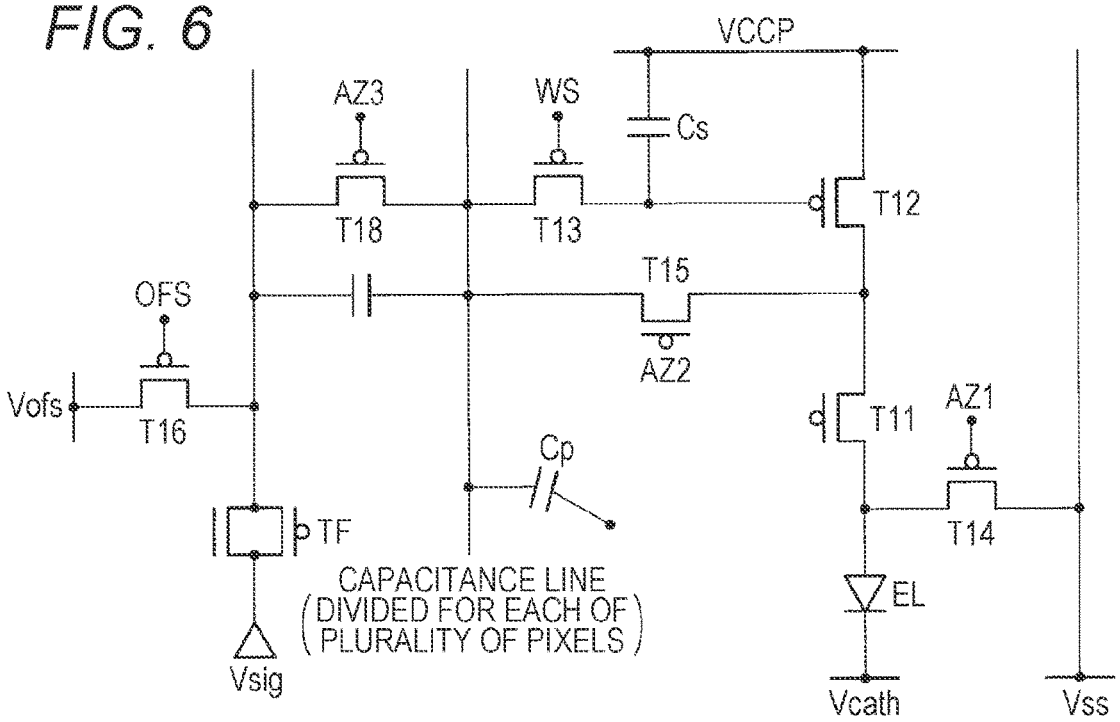
RELATED ART FIG. 6
FIG. 6 is an explanatory diagram illustrating an example of the pixel circuit.

Furthermore, in order to speed up driving of a pixel circuit, a pixel circuit is proposed aiming at reducing the capacitance by separately providing a capacitance line for correction and dividing the capacitance line into a plurality of pixels to increase correction speed. FIG. 6 is an explanatory diagram illustrating an example of a pixel circuit including six P-channel transistors and one capacitor. The pixel circuit illustrated in FIG. 6 includes P-channel transistors T11 to T15 and T18, an organic EL element EL, and a capacitive element Cs. Details of driving of the pixel circuit are described in, for example, Japanese Patent Application Laid-Open No. 2016-038425 and the like, and the detailed description is omitted.

The drive transistor in each of the pixel circuits illustrated in FIGS. 5 and 6 is the transistor T12. Also in each of the pixel circuits illustrated in FIGS. 5 and 6, the operating point of the transistor T12, which is the drive transistor, must not change during still image display.

Therefore, a method can be adopted in which transistors is added to each of the pixel circuits illustrated in FIGS. 5 and 6 to suppress a leakage current of the transistors and to suppress a decrease in luminance during display of a still image.

Figure 7:
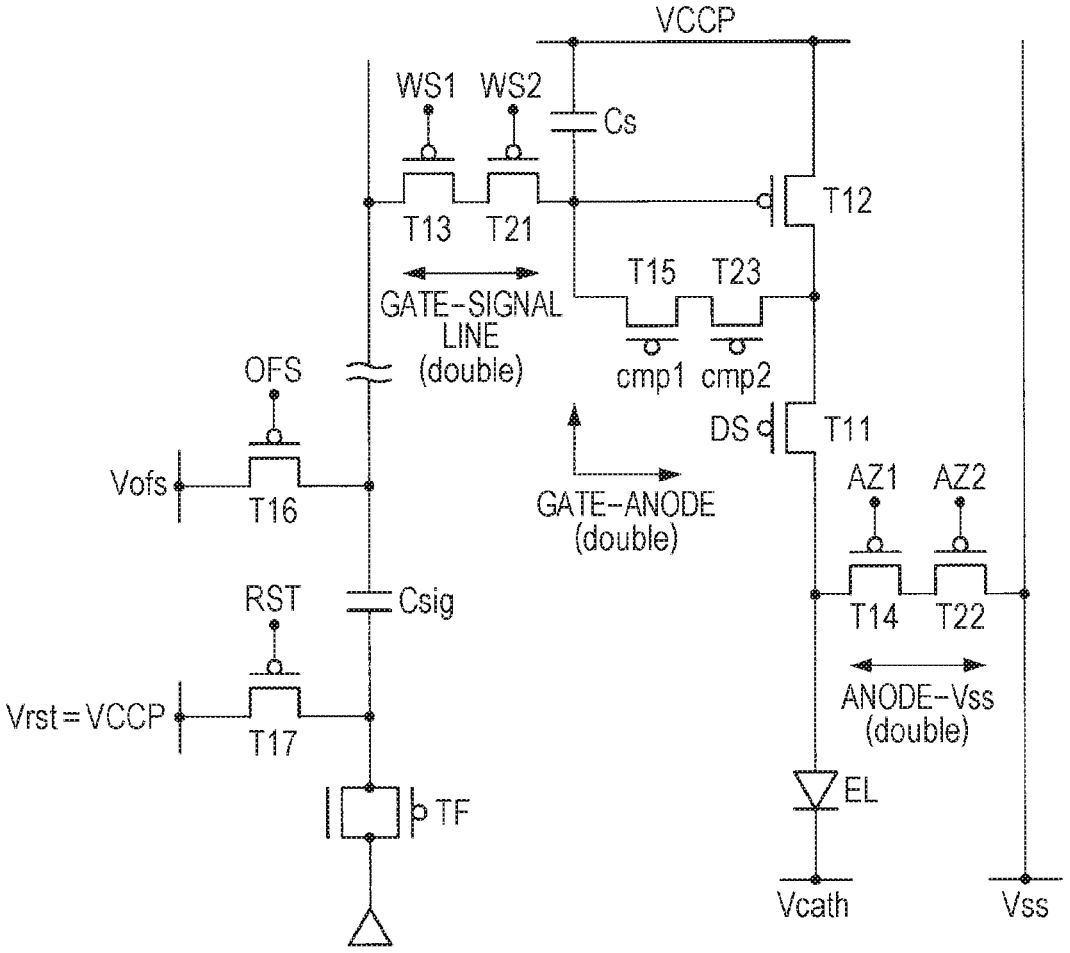
FIG. 7 is an explanatory diagram illustrating an example of the pixel circuit.

FIG. 7 is an explanatory diagram illustrating a configuration example of a pixel circuit in which transistors are added to the pixel circuit illustrated in FIG. 5 to suppress a leakage current of the transistors. The pixel circuit illustrated in FIG. 7 has a configuration in which P-channel transistors T21, T22, and T23 are added to the pixel circuit illustrated in FIG. 5. By adding the transistors T21, T22, and T23 as described above, there are two transistors between the gate of the transistor T21, which is the drive transistor, and a signal line to which a signal Vsig is supplied, there are two transistors between the anode of the organic EL element EL and a signal line that supplies the reset voltage Vss, and there are two transistors between the gate and the anode of the organic EL element EL. Since each of the numbers of transistors is increased, a leakage current from the transistors can be suppressed.

Figure 8:
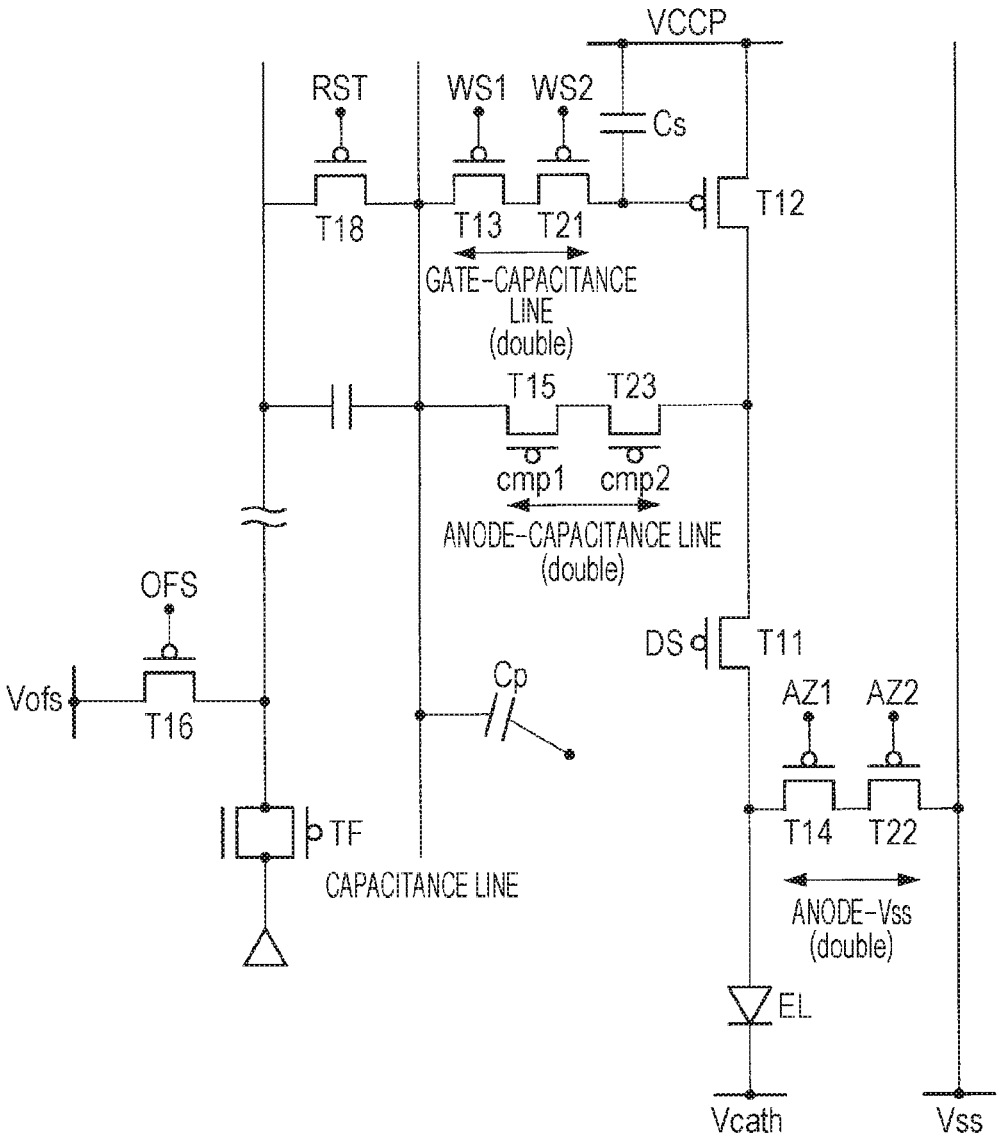
FIG. 8 is an explanatory diagram illustrating an example of the pixel circuit.

FIG. 8 is an explanatory diagram illustrating a configuration example of a pixel circuit in which transistors are added to the pixel circuit illustrated in FIG. 5 in order to suppress a leakage current of the transistors. The pixel circuit illustrated in FIG. 8 has a configuration in which P-channel transistors T21, T22, and T23 are added to the pixel circuit illustrated in FIG. 6. By adding the transistors T21, T22, and T23 as described above, there are two transistors between the gate of the transistor T21, which is the drive transistor, and a capacitance line, there are two transistors between the anode of an organic EL element EL and a signal line that supplies a reset voltage Vss, and there are two transistors between the anode of the organic EL element EL and the capacitance line. As a result, a leakage current can be suppressed.

However, the pixel circuit illustrated in FIG. 4 includes two more transistors than those of the pixel circuit illustrated in FIG. 3, and the pixel circuits illustrated in FIGS. 7 and 8 have three more pixels than those of the pixel circuits illustrated in FIGS. 5 and 6. As described above, if the number of transistors in the pixel circuit is increased in order to maintain the operating point of the drive transistor, a pixel layout at a narrow pitch becomes difficult, which hinders high definition of the display.

Accordingly, in view of the above, the disclosing party of the present case has intensively studied a technology capable of suppressing a leakage current and maintaining the operating point of a drive transistor during still image display without increasing the number of transistors or with a minimum increase in the number of transistors even if the number is increased, in a pixel circuit of a display device using an organic EL element. As a result, as described below, the disclosing party of the present case has devised a technology capable of suppressing a leakage current and maintaining the operating point of a drive transistor during still image display without increasing the number of transistors or with a minimum increase in the number of transistors even if the number is increased, in a pixel circuit of a display device using an organic EL element.

(Four-Transistor Pixel Circuit)

Figure 9:
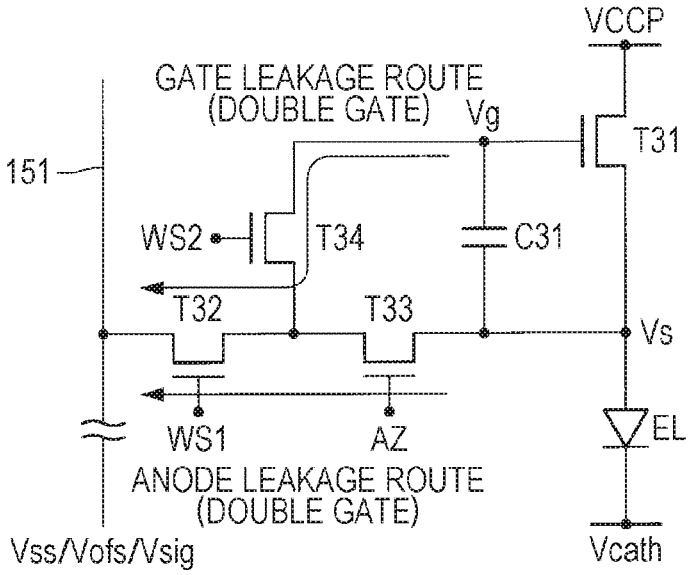
FIG. 9 is an explanatory diagram illustrating an example of a pixel circuit according to the embodiment.

First, as an embodiment of the present disclosure, an example of a pixel circuit including three N-channel transistors will be described. FIG. 9 is an explanatory diagram illustrating an example of a pixel circuit according to an embodiment of the present disclosure. The pixel circuit illustrated in FIG. 9 includes N-channel transistors T31, T32, T33, and T34, a capacitor C31, and an organic EL element EL. The pixel circuit illustrated in FIG. 9 is based on the pixel circuit illustrated in FIG. 3.

The transistor T31 is a drive transistor for supplying a current to the organic EL element EL, the transistor T32 is a write transistor for writing a video signal, and the transistor T33 is a reset transistor for extinguishing light of the organic EL element EL and resetting an anode potential. The pixel circuit illustrated in FIG. 9 is a circuit having a function of correcting a threshold voltage (Vth correction) of the transistor T1, which is the drive transistor, and a function of correcting variation in mobility.

The pixel circuit illustrated in FIG. 9 is based on the pixel circuit illustrated in FIG. 3; however, is different from the pixel circuit illustrated in FIG. 4 in that one N-channel transistor is added to the pixel circuit illustrated in FIG. 3. The pixel circuit illustrated in FIG. 9 includes the transistor T34, and therefore, there are two transistors between the gate of the transistor T31, which is the drive transistor, and a signal line 151 to which signals Vsig, Vss, and Vofs are supplied, and there are two transistors between the anode of the organic EL element EL and a signal line that supplies a reset voltage Vss.

By configuring the pixel circuit in this manner, it is possible to suppress a leakage current of the drive transistor and to suppress a decrease in luminance during display of a still image.

Figure 10:
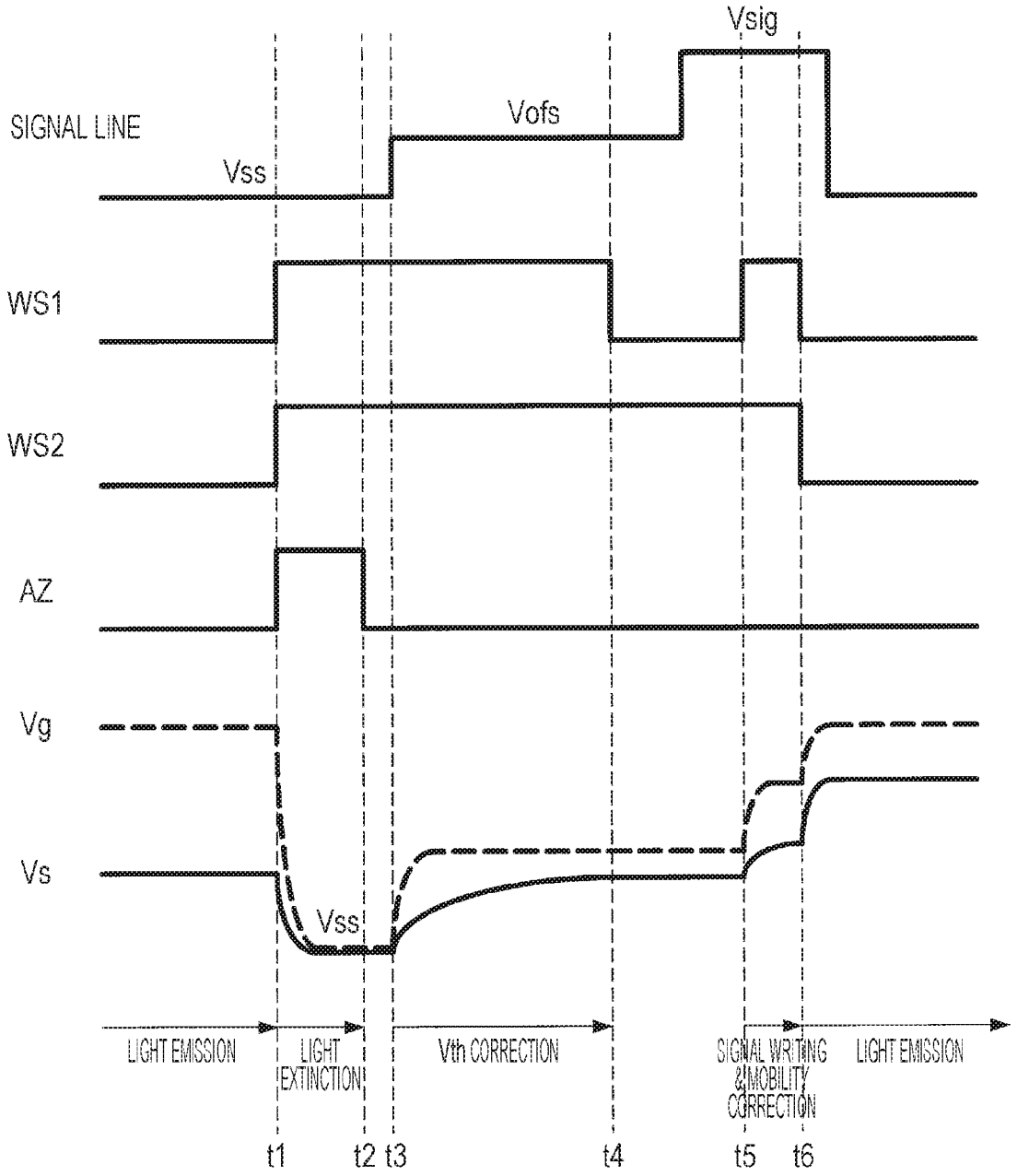
FIG. 10 is an explanatory diagram illustrating how the pixel circuit illustrated in FIG. 9 is driven.

FIG. 10 is an explanatory diagram illustrating how the pixel circuit illustrated in FIG. 9 is driven. An example of driving the pixel circuit illustrated in FIG. 9 will be described with reference to FIG. 10.

A light-emission period continues until a time point t1, and the light emission period ends at the time point t1, and a light-extinction period starts. At the time point t1, each of the signal lines WS1, WS2, and AZ is switched from low to high. If all the signal lines WS1, WS2, and AZ are switched from low to high, the transistors T32, T33, and T34 are turned on, respectively. If the transistors T32, T33, and T34 are turned on, a gate potential Vg of the transistor T31 and a source potential (anode potential of the organic EL element EL) Vs of the transistor T31 start to decrease, and all the gate potential Vg and the source potential Vs drop to a potential VSS of the signal line 151.

At a time point t2, the light-extinction period ends, and the signal line AZ is switched from high to low. If the signal line AZ is switched to low, the transistor T33 is turned off, and the anode of the organic EL element EL is disconnected from the signal line 151.

Subsequently, a Vth correction period starts at a time point t3, and the potential of the signal line 151 rises from Vss to Vofs. If the potential of the signal line 151 rises from Vss to Vofs, the gate potential Vg of the transistor T31 starts to rise to Vofs. Furthermore, until the source potential of the transistor T31 connected to the gate of the transistor T31 via a capacitance C31 reaches a value obtained by subtracting a threshold voltage Vth of the transistor T31 from Vofs, the source potential gradually rises along with a rise of the potential of the signal line 151.

At a time point t4, the Vth correction period ends, and the signal line WS1 is switched from high to low. If the signal line AZ is switched to low, the transistor T32 is turned off, and the gate of the transistor T31 is disconnected from the signal line 151.

After a time point t4, the potential of the signal line 151 changes from Vofs to a potential Vsig of the video signal. Thereafter, at a time point t5, a signal writing and movement correction period starts. At a time point t5, the signal line WS1 is switched from low to high. If the signal line AZ is switched to high, the transistor T32 is turned on and the gate of the transistor T31 is connected to the signal line 151. During this period, since an output current of the transistor T31 is negatively fed back to the capacitor C31, the gate-source voltage Vgs of the transistor T31 becomes a value reflecting mobility μ, and after a certain time has passed, the gate-source voltage Vgs becomes a value obtained by completely correcting the mobility μ.

Therefore, the gate potential Vg of the transistor T31 starts to rise to Vsig. Furthermore, the source potential of the transistor T31 connected to the gate of the transistor T31 via the capacitance C31 rises along with a rise of the potential of the signal line 151.

Subsequently, at a time point t6, the signal writing and movement correction period ends, and a light-emission period starts. At the time point t6, the signal lines WS1 and WS2 are switched to low. If the signal lines WS1 and WS2 are switched to low, the transistors T32 and T34 are turned off, and the gate of the transistor T31 and the anode of the organic EL element EL are disconnected from the signal line 151. As a result, it is possible to raise the gate potential of the transistor T31. While keeping the value of the gate-source voltage Vgs held in the capacitor C31 constant, the potential of the source potential Vs of the transistor T31 increases in association with the increase in the gate potential Vg of the transistor T31. As a result, a reverse bias state of the organic EL element EL is eliminated, and the transistor T31 allows a drain current according to the gate-source voltage Vgs to flow through the organic EL element EL. If a current flows from the transistor T31, the organic EL element EL emits light. Note that the potential of the signal line 151 is lowered to Vss at an any timing in the light-emission period.

As described above, in the pixel circuit illustrated in FIG. 9, the threshold voltage of the transistor T31, which is the drive transistor, and the variation in mobility can be corrected without any problem even if the transistor T34 is provided. Then, in the pixel circuit illustrated in FIG. 9, a leakage current of the drive transistor can be suppressed and a decrease in luminance during display of a still image can be suppressed.

(Five-Transistor Pixel Circuit)

Figure 11:
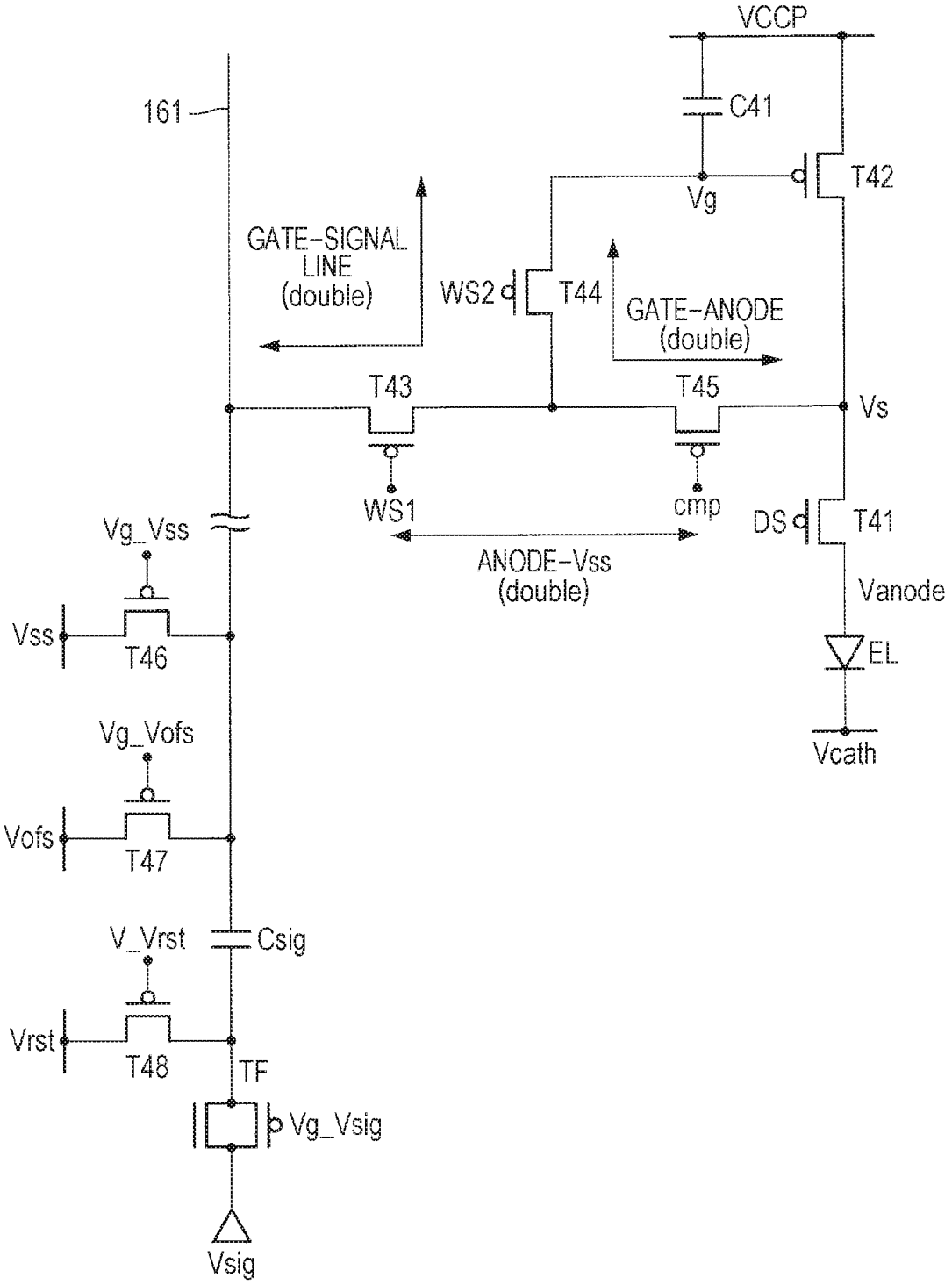
FIG. 11 is an explanatory diagram illustrating an example of the pixel circuit according to the embodiment.

Subsequently, as an embodiment of the present disclosure, an example of a pixel circuit including five P-channel transistors will be described. FIG. 11 is an explanatory diagram illustrating an example of a pixel circuit according to an embodiment of the present disclosure. The pixel circuit illustrated in FIG. 11 includes P-channel transistors T41, T42, T43, T44, and T45, a capacitor C41, and an organic EL element EL. The pixel circuit illustrated in FIG. 11 is based on the pixel circuit illustrated in FIG. 4. Furthermore, in FIG. 11, a capacitive element Csig and P-channel transistors T46, T47, and T48 are illustrated. These transistors T46, T47, and T48 function as a level shift circuit that shifts an output voltage of the transfer gate TF.

The transistor T41 has a gate connected to a signal line DS, a drain connected to the anode of the organic EL element EL, and a source connected to the drain of the transistor T42. The transistor T42 is a drive transistor. A video signal Vsig is supplied to the gate of the transistor T42 via the transistors T43 and T44, and the source of the transistor T42 is connected to a power supply voltage VCCP. The transistors T43 and T44 are write transistors. The gate of the transistor T43 is connected to a signal line WS1. Furthermore, the source of the transistor T43 is connected to a signal line 161. The gate of the transistor T44 is connected to a signal line WS2. Furthermore, the source of the transistor T44 is connected to the drain of the transistor T43. The gate of the transistor T45 is connected to a signal line cmp.

Furthermore, the transistor T46 controls supply of a potential Vss to the signal line 161 and has a gate connected to a signal line Vg_Vss. The transistor T47 controls supply of a potential Vofs to the signal line 161 and has a gate connected to a signal line Vg_Vofs. The transistor T48 controls supply of a potential Vrst to the signal line 161 and has a gate connected to a signal line Vg_Vrst. Note that is assumed that Vofs>Vss.

The pixel circuit illustrated in FIG. 11 is based on the pixel circuit illustrated in FIG. 4; however, is different from the pixel circuit illustrated in FIG. 7 in that the number of transistors in the pixel circuit illustrated in FIG. 11 is not increased from that in the pixel circuit illustrated in FIG. 4. In the pixel circuit illustrated in FIG. 11, since the transistor T43 is provided, there are two transistors between the gate of the transistor T42, which is a drive transistor, and the signal line 161, between the drain of the transistor T42 and the signal line that supplies the signal line 161, and between the gate and the drain of the transistor T42, which is a drive transistor.

By configuring the pixel circuit in this manner, it is possible to suppress a leakage current of the drive transistor and to suppress a decrease in luminance during display of a still image.

Figure 12:
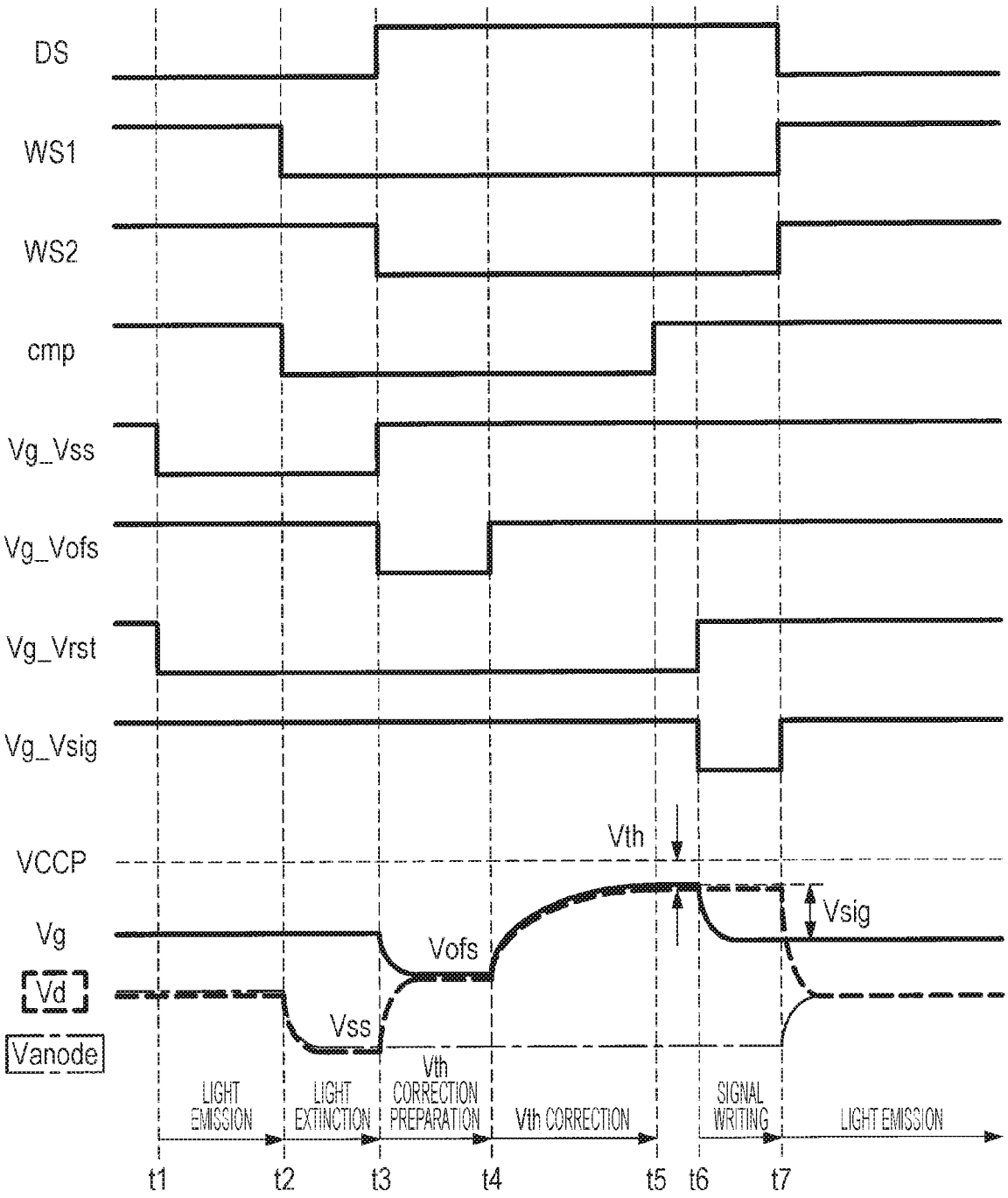
FIG. 12 is an explanatory diagram illustrating how the pixel circuit illustrated in FIG. 11 is driven.

FIG. 12 is an explanatory diagram illustrating how the pixel circuit illustrated in FIG. 11 is driven. An example of driving the pixel circuit illustrated in FIG. 11 will be described with reference to FIG. 12.

At a time point t1 during a light-emission period, the signal lines Vg_Vss and Vg_Vrst are switched from high to low. If the signal lines Vg_Vss and Vg_Vrst are switched from high to low, the transistors T46 and T48 are turned on, respectively. Furthermore, at this time, since the signal line DS remains to be low, the transistor T41 is also turned on.

Thereafter, the light-emission period ends at a time point t2, and a light-extinction period starts. At the time point t2, the signal lines WS1 and cmp are switched from high to low. If the signal lines WS1 and cmp are switched from high to low, the transistors T43 and T45 are turned on. If the transistors T43 and T45 are turned on, the transistors T41 and T46 are turned on. Therefore, a drain potential Vd of the transistor T42 and an anode potential Vanode of the organic EL element EL are lowered to Vss.

Thereafter, at a time point t3, the light-extinction period ends, and a Vth correction preparation period starts. At the time point t3, the signal line DS is switched from low to high, the signal line WS2 is switched from high to low, the signal line Vg_Vss is switched from low to high, and the signal line Vg_Vofs is switched from high to low. If the signal line DS is switched from low to high, the transistor T41 is turned off, and the drain of the transistor T42 is disconnected from the anode of the organic EL element EL. Furthermore, if the signal line WS2 is switched from high to low, the transistor T44 is turned on. Moreover, if the signal line Vg_Vss is switched from low to high, the transistor T46 is turned off. Furthermore, if the signal line Vg_Vofs is switched from high to low, the transistor T47 is turned on.

Therefore, the gate potential Vg of the transistor T42 is lowered to Vofs, and furthermore, the drain potential Vd of the transistor T42 rises to Vofs. Note that since the transistor T41 is turned off and the drain of the transistor T42 is disconnected from the anode of the organic EL element EL, the anode potential of the organic EL element EL does not change.

Thereafter, at a time point t4, the Vth correction preparation period ends, and a Vth correction period starts. At the time point t4, the signal line Vg_Vofs is switched from low to high. If the signal line Vg_Vofs is switched from low to high, the transistor T47 is turned off. Therefore, the gate potential Vg and the drain potential Vd of the transistor T42 rise to a potential obtained by subtracting the threshold voltage Vth of the transistor T42 from the power supply voltage VCCP.

Thereafter, at a time point t5, the Vth correction period ends. At the time point t5, the signal line cmp is switched from low to high. If the signal line cmp is switched from low to high, the transistor T45 is turned off. If the transistor T45 is turned off, the drain of the transistor T42 is disconnected from the signal line 161.

Thereafter, a signal writing period starts at a time point t6. At the time point t6, the signal line Vg_Vrst is switched from low to high. Furthermore, at the time point t6, the signal line Vg_Vsig is switched from high to low. If the signal line Vg_Vrst is switched from low to high, the transistor T48 is turned off. Furthermore, if the signal line Vg_Vsig is switched from high to low, the signal voltage Vsig of the video signal is supplied to the signal line 161.

At this time point, the transistor T45 remains to be turned off, and the drain of the transistor T42 is disconnected from the signal line 161. Therefore, if the signal voltage Vsig is supplied to the signal line 161, the gate potential Vg of the transistor T42 is lowered until the potential difference between the gate potential Vg of the transistor T42 and the drain potential Vd of the transistor T42 becomes the signal voltage Vsig of the video signal. Therefore, the video signal is written to the transistor T42.

Thereafter, at a time point t7, the signal writing period ends, and a light-emission period starts. At a time point t7, the signal line DS is switched from high to low. Furthermore, at the time point t7, the signal lines WS1 and WS2 are switched from low to high. Moreover, at the time point t7, the signal line Vg_Vsig is switched from low to high. Therefore, the transistor T41 is turned on, the transistors T43 and T44 are turned off, and supply of the video signal to the signal line 161 is stopped. If the transistor T41 is turned on, the drain potential Vd of the transistor T42 becomes equal to the anode potential Vanode of the organic EL element EL. If the drain potential Vd of the transistor T42 decreases, the transistor T42 allows a current to flow through the organic EL element EL. If a current flows from the transistor T42, the organic EL element EL emits light.

As described above, the pixel circuit illustrated in FIG. 11 can correct the threshold voltage of the transistor T42, which is the drive transistor, with no problem without an increase in the number of transistors per pixel from the number in the pixel circuit illustrated in FIG. 5. Then, in the pixel circuit illustrated in FIG. 11, a leakage current of the drive transistor can be suppressed and a decrease in luminance during display of a still image can be suppressed without an increase in the number of transistors per pixel from the number in the pixel circuit illustrated in FIG. 5.

(Six-Transistor Pixel Circuit)

Figure 13:
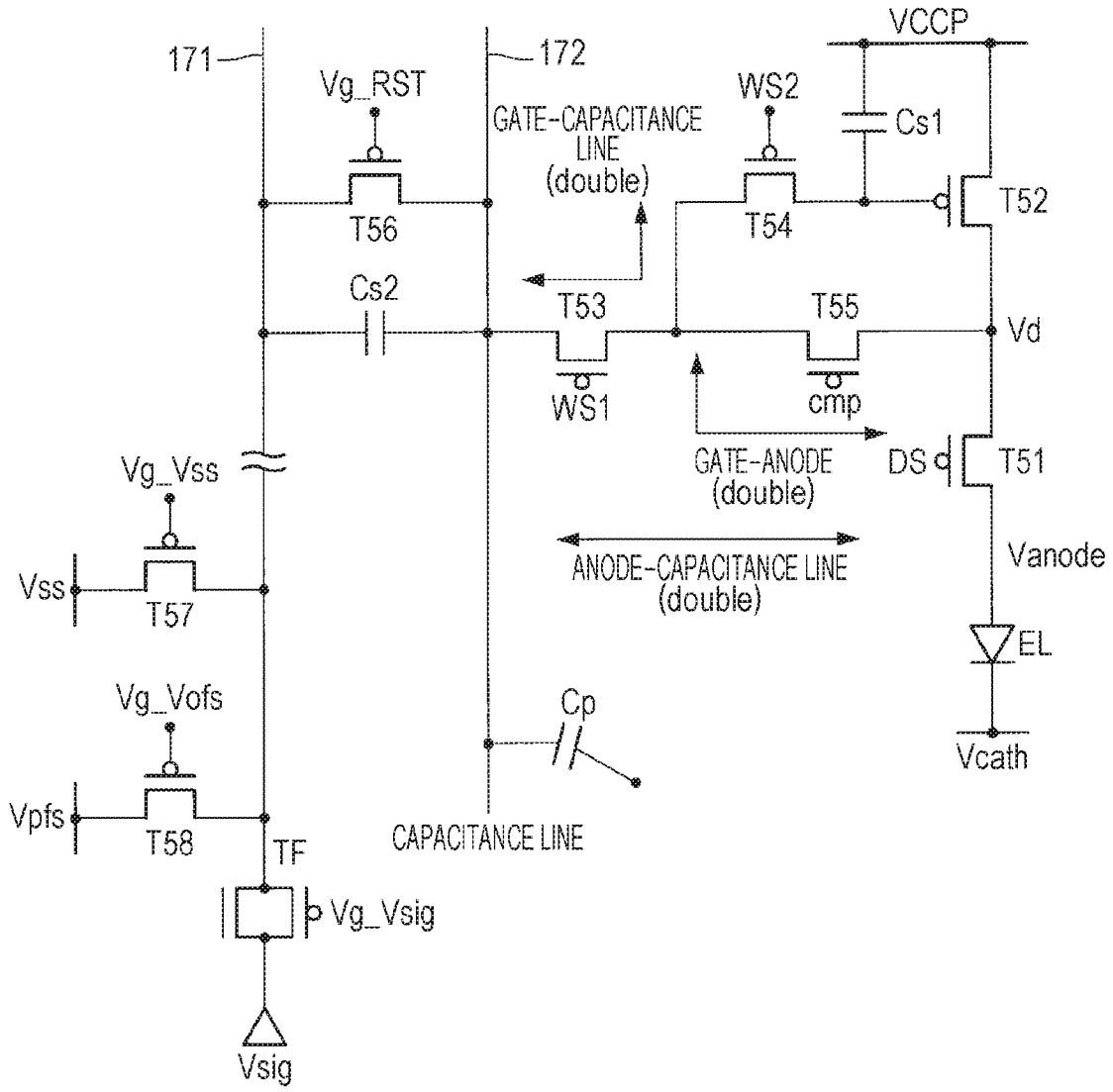
FIG. 13 is an explanatory diagram illustrating an example of the pixel circuit according to the embodiment.

Subsequently, as an embodiment of the present disclosure, an example of a pixel circuit including six P-channel transistors will be described. FIG. 13 is an explanatory diagram illustrating an example of a pixel circuit according to an embodiment of the present disclosure. The pixel circuit illustrated in FIG. 13 includes P-channel transistors T51, T52, T53, T54, T55, and T56, capacitors Cs1 and Cs2, and an organic EL element EL. The pixel circuit illustrated in FIG. 13 is based on the pixel circuit illustrated in FIG. 5. Furthermore, in FIG. 13, P-channel transistors T57 and T58 are illustrated. These transistors T57 and T58 function as a level shift circuit that shifts an output voltage of a transfer gate TF.

The transistor T51 has a gate connected to a signal line DS, a drain connected to the anode of the organic EL element EL, and a source connected to the drain of the transistor T52. The transistor T52 is a drive transistor. A video signal Vsig is supplied to the gate of the transistor T52 via the transistors T53, T54, and T56, and the source of the transistor T52 is connected to a power supply voltage VCCP. The transistors T53 and T54 are write transistors. The gate of the transistor T53 is connected to the signal line WS1. Furthermore, the source of the transistor T53 is connected to a signal line 171. The gate of the transistor T54 is connected to a signal line WS2. Furthermore, the source of the transistor T54 is connected to the drain of the transistor T53. The gate of the transistor T55 is connected to a signal line cmp. The transistor T56 is provided between the signal line 171 and a capacitance line 172, and has a gate connected to a signal line Vg_RST.

Furthermore, the transistor T57 controls supply of a potential Vss to the signal line 171, and has a gate connected to a signal line Vg_Vss. The transistor T58 controls supply of a potential Vofs to the signal line 171 and has a gate connected to a signal line Vg_Vofs. Note that is assumed that Vofs>Vss.

The pixel circuit illustrated in FIG. 13 is based on the pixel circuit illustrated in FIG. 6; however, is different from the pixel circuit illustrated in FIG. 8 in that the number of transistors in the pixel circuit illustrated in FIG. 13 is not increased from that in the pixel circuit illustrated in FIG. 6. In the pixel circuit illustrated in FIG. 13, since the transistor T53 is provided, there are two transistors between the gate of the transistor T52, which is a drive transistor, and a capacitance line 172, between the drain of the transistor T52 and the capacitance line 172, and between the gate and the drain of the transistor T52.

By configuring the pixel circuit in this manner, it is possible to suppress a leakage current of the drive transistor and to suppress a decrease in luminance during display of a still image.

Figure 14:
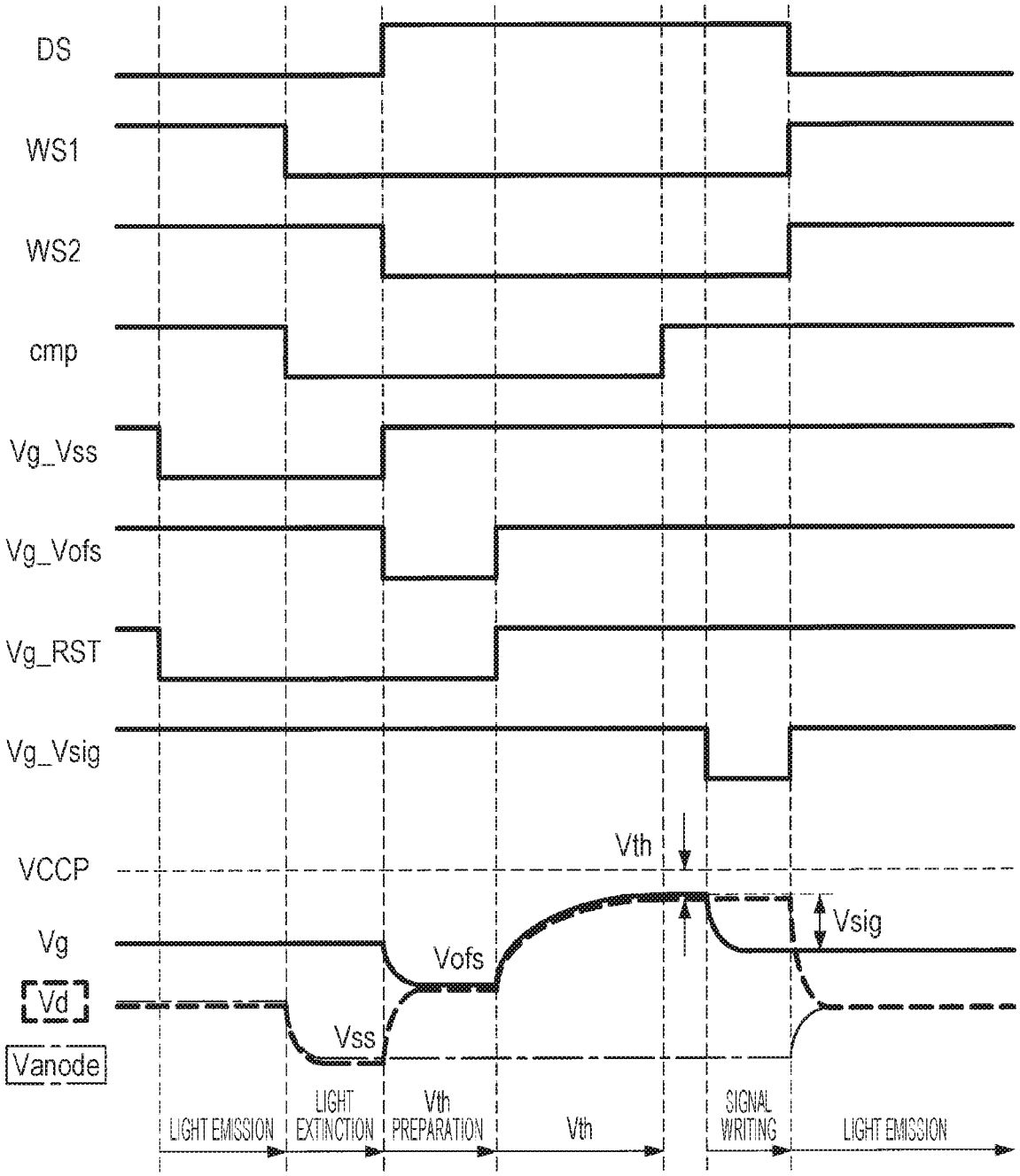
FIG. 14 is an explanatory diagram illustrating how the pixel circuit illustrated in FIG. 13 is driven.

FIG. 14 is an explanatory diagram illustrating how the pixel circuit illustrated in FIG. 13 is driven. An example of driving the pixel circuit illustrated in FIG. 13 will be described with reference to FIG. 14.

At a time point t1 during a light-emission period, the signal lines Vg_Vss and Vg_RST are switched from high to low. If the signal lines Vg_Vss and Vg_RST are switched from high to low, the transistors T57 and T56 are turned on, respectively. Furthermore, at this time, since the signal line DS remains to be low, the transistor T51 is also turned on.

Thereafter, the light-emission period ends at a time point t2, and a light-extinction period starts. At the time point t2, the signal lines WS1 and cmp are switched from high to low. If the signal line WS1 and the signal line cmp are switched from high to low, the transistors T53 and T55 are turned on. If the transistors T53 and T55 are turned on, the transistors T51 and T56 are turned on. Therefore, a drain potential Vd of the transistor T52 and an anode potential Vanode of the organic EL element EL are lowered to Vss.

Thereafter, at a time point t3, the light-extinction period ends, and a Vth correction preparation period starts. At the time point t3, the signal line DS is switched from low to high, the signal line WS2 is switched from high to low, the signal line Vg_Vss is switched from low to high, and the signal line Vg_Vofs is switched from high to low. If the signal line DS is switched from low to high, the transistor T51 is turned off, and the drain of the transistor T52 is disconnected from the anode of the organic EL element EL. Furthermore, the signal line WS2 is switched from high to low, the transistor T54 is turned on. Moreover, if the signal line Vg_Vss is switched from low to high, the transistor T57 is turned off. Furthermore, if the signal line Vg_Vofs is switched from high to low, the transistor T58 is turned on.

Therefore, the gate potential Vg of the transistor T52 is lowered to Vofs, and furthermore, the drain potential Vd of the transistor T52 rises to Vofs. Note that since the transistor T51 is turned off and the drain of the transistor T52 is disconnected from the anode of the organic EL element EL, the anode potential of the organic EL element EL does not change.

Thereafter, at a time point t4, the Vth correction preparation period ends, and a Vth correction period starts. At a time point t4, the signal lines Vg_Vofs and Vg_RST are switched from low to high. If the signal line Vg_Vofs is switched from low to high, the transistor T58 is turned off. Furthermore, if the signal line Vg_RST is switched from low to high, the transistor T56 is turned off. Therefore, the gate potential Vg and the drain potential Vd of the transistor T52 rise to a potential obtained by subtracting a threshold voltage Vth of the transistor T52 from the power supply voltage VCCP.

Thereafter, at a time point t5, the Vth correction period ends. At the time point t5, the signal line cmp is switched from low to high. If the signal line cmp is switched from low to high, the transistor T55 is turned off. If the transistor T55 is turned off, the drain of the transistor T52 is disconnected from the capacitance line 172.

Thereafter, a signal writing period starts at a time point t6. At the time point t6, the signal line Vg_Vsig is switched from high to low. If the signal line Vg_Vsig is switched from high to low, the signal voltage Vsig of the video signal is supplied to the signal line 171.

At this time point, the transistor T55 remains to be turned off, and the drain of the transistor T52 is disconnected from the capacitance line 172. Therefore, if the signal voltage Vsig is supplied to the signal line 171, the gate potential Vg of the transistor T52 is lowered until the potential difference between the gate potential Vg of the transistor T52 and the drain potential Vd of the transistor T52 becomes the signal voltage Vsig of the video signal. Therefore, the video signal is written to the transistor T52.

Thereafter, at a time point t7, the signal writing period ends, and a light-emission period starts. At a time point t7, the signal line DS is switched from high to low. Furthermore, at the time point t7, the signal lines WS1 and WS2 are switched from low to high. Moreover, at the time point t7, the signal line Vg_Vsig is switched from low to high. Therefore, the transistor T51 is turned on, the transistors T53 and T54 are turned off, and supply of the video signal to the signal line 171 is stopped. If the transistor T51 is turned on, the drain potential Vd of the transistor T52 becomes equal to the anode potential Vanode of the organic EL element EL. If the drain potential Vd of the transistor T52 is lowered, the transistor T52 allows a current to flow through the organic EL element EL. If a current flows from the transistor T52, the organic EL element EL emits light.

As described above, the pixel circuit illustrated in FIG. 13 can correct the threshold voltage of the transistor T52, which is a drive transistor, with no problem without an increase the number of transistors per pixel from the number in the pixel circuit illustrated in FIG. 6. Then, in the pixel circuit illustrated in FIG. 13, a leakage current of the drive transistor can be suppressed and a decrease in luminance during display of a still image can be suppressed without an increase in the number of transistors per pixel from the number in the pixel circuit illustrated in FIG. 6.

2. Summary

As described above, according to the embodiments of the present disclosure, the pixel circuit of the display device using an organic EL element is provided. In the pixel circuit, the gate node of the drive transistor and the anode node of the organic EL element are connected via transistors, and furthermore, transistors are provided between wiring shared by a plurality of pixels such as a signal line.

In the pixel circuit according to the embodiments of the present disclosure, by providing the transistors in this manner, the two transistors connect the gate node of the drive transistor and the anode node of the organic EL element to various signal lines. By connecting the nodes with two transistors in this manner, the pixel circuit according to the embodiments of the present disclosure can suppress fluctuation of the operating point of each node due to a leakage current and suppress deterioration in luminance during low-frequency driving without increasing the number of transistors or with a minimum increase even if the number is increased.

Then, a display device including the pixel circuit according to the embodiments of the present disclosure and an electronic apparatus including such a display device are also provided. Examples of such an electronic apparatus include a television, a mobile phone such as a smartphone, a tablet-type mobile terminal, a personal computer, a mobile game console, a mobile music player, a digital still camera, a digital video camera, a wristwatch-type mobile terminal, a wearable device, and the like.

While the preferred embodiments of the present disclosure have been described in detail with reference to the accompanying drawings, the technical scope of the present disclosure is not limited to such examples. It is obvious that a person skilled in the art of the present disclosure can conceive various modifications and corrections within the scope of the technical idea described in the claims, and it is naturally understood that these modifications and corrections also belong to the technical scope of the present disclosure.

Furthermore, the effects described in the present Description are illustrative or exemplary only and are not limited. That is, the technology according to the present disclosure can exhibit other effects that are apparent to those skilled in the art from the description of the present Description in addition to or in lieu of the effects described above.

Note that the following configurations also belong to the technical scope of the present disclosure.

(1)

A pixel circuit including a light-emitting element, a drive transistor configured to supply a current to the light-emitting element, a first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor.

(2)

The pixel circuit according to the (1), further including a light-emission control transistor configured to control connection between the drive transistor and the anode of the light-emitting element.

(3)

The pixel circuit according to the (2), further including a second reset transistor provided between a signal line to which the signal voltage is supplied and a capacitance line to which a capacitance that corrects a threshold voltage of the drive transistor is connected.

(4)

The pixel circuit according to any one of the (1) to (3), in which all the drive transistor, the first reset transistor, the first write transistor, and the second write transistor are N-channel transistors.

(5)

The pixel circuit according to any one of the (1) to (3), in which all the drive transistor, the first reset transistor, the first write transistor, and the second write transistor are P-channel transistors.

(6)

A display device including the pixel circuit according to any one of the (1) to (5).

(7)

An electronic apparatus including the display device according to the (6).

(8)

A driving method of a pixel circuit including a light-emitting element, a drive transistor configured to supply a current to the light-emitting element, a first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor, the method including turning on the first write transistor and the second write transistor in a first period after light emission ends, correcting the threshold voltage of the drive transistor in a second period after the first period, writing a signal voltage to the drive transistor in a third period after the second period, and turning off the first write transistor and the second write transistor and allowing a current to flow through the light-emitting element through the drive transistor to cause the light-emitting element to emit light in a fourth period after the third period.

(9)

The driving method of the pixel circuit according to the (8), in which the second write transistor is turned on after the first write transistor is turned on in the first period.

(10)

The driving method of the pixel circuit according to the (8) or (9), in which the pixel circuit further includes a light-emission control transistor that controls connection between the drive transistor and the anode of the light-emitting element.

(11)

The driving method of the pixel circuit according to the (10), in which the pixel circuit further includes a second reset transistor provided between a signal line to which the signal voltage is supplied and a capacitance line to which a capacitance that corrects the threshold voltage of the drive transistor is connected.

REFERENCE SIGNS LIST

100 Display device
110 Pixel unit
111B Pixel
111G Pixel
111R Pixel
120 Horizontal selector
130 Vertical scanner
131 Auto zero scanner
132 Drive scanner
133 Write scanner

The invention claimed is:

1. A pixel circuit comprising:

a light-emitting element;

a drive transistor configured to supply a current to the light-emitting element;

a first reset transistor configured to set a potential of an anode of the light-emitting element to a predetermined potential;

a first write transistor configured to control writing of a signal voltage at a gate node of the drive transistor;

a holding capacitance having one end connected to the gate node of the drive transistor and configured to hold a threshold voltage of the drive transistor; and a second write transistor connected in series between the gate node of the drive transistor and the first write transistor, wherein all the drive transistor, the first reset transistor, the first write transistor, and the second write transistor are P-channel transistors, and wherein a gate of the first write transistor is connected to receive a first control signal from a first control signal line, and a gate of the second write transistor is connected to receive a second control signal from a second control signal line.

2. A display device comprising the pixel circuit according to claim 1.

3. An electronic apparatus comprising the display device according to claim 2.

4. The pixel circuit according to claim 1, further comprising a light-emission control transistor configured to control connection between the drive transistor and the anode of the light-emitting element.

5. The pixel circuit according to claim 4, further comprising a second reset transistor provided between a signal line to which the signal voltage is supplied and a capacitance line to which a capacitance that corrects the threshold voltage of the drive transistor is connected.

6. The pixel circuit according to claim 1, wherein the second control signal causes the second write transistor to be turned on after the first control signal causes the first write transistor to have been turned on in the first period.

7. A driving method of a pixel circuit including a light-emitting element, a drive transistor configured to supply a current to the light-emitting element, a first reset transistor configured to set a potential of an anode of the light-emitting element to a predetermined potential, a first write transistor configured to control writing of a signal voltage at a gate node of the drive transistor, a holding capacitance having one end connected to the gate node of the drive transistor and configured to hold a threshold voltage of the drive transistor, and a second write transistor connected in series between the gate node of the drive transistor and the first write transistor, the method comprising:

turning on the first write transistor and the second write transistor in a first period after light emission ends;

correcting the threshold voltage of the drive transistor in a second period after the first period;

writing a signal voltage to the drive transistor in a third period after the second period; and turning off the first write transistor and the second write transistor and allowing a current to flow through the light-emitting element through the drive transistor to cause the light-emitting element to emit light in a fourth period after the third period, wherein the second write transistor is turned on after the first write transistor is turned on in the first period.

8. The driving method of the pixel circuit according to claim 7, wherein the pixel circuit further includes a light-emission control transistor that controls connection between the drive transistor and the anode of the light-emitting element.

9. The driving method of the pixel circuit according to claim 8, wherein the pixel circuit further includes a second reset transistor provided between a signal line to which the signal voltage is supplied and a capacitance line to which a capacitance that corrects the threshold voltage of the drive transistor is connected.

10. The driving method of the pixel circuit according to claim 7, wherein all the drive transistor, the first reset transistor, the first write transistor, and the second write transistor are P-channel transistors.

* * * * *